United States Patent [19]

Kaegebein

[11] Patent Number: 4,493,422

[45] Date of Patent: Jan. 15, 1985

[54] FIXTURE FOR MOUNTING CYLINDRICAL CAVITY FILTERS

[75] Inventor: Daniel P. Kaegebein, Depew, N.Y.

[73] Assignee: TX RX Systems, Inc., Angola, N.Y.

[21] Appl. No.: 399,902

[22] Filed: Jul. 19, 1982

[51] Int. Cl.[3] ..... A47F 7/00

[52] U.S. Cl. ..... 211/26; 211/71

[58] Field of Search ..... 211/26, 71, 44, 189, 211/113; 361/331, 420, 429

[56] References Cited

U.S. PATENT DOCUMENTS

| | | | |
|---|---|---|---|
| 3,132,288 | 5/1964 | Talentinow | 361/429 X |
| 3,326,505 | 6/1967 | Jamar | 211/189 X |
| 3,963,125 | 6/1976 | Baggott | 211/71 X |
| 4,270,722 | 6/1981 | Batchelder | 211/71 X |
| 4,327,836 | 5/1982 | Okuno | 211/74 |
| 4,381,838 | 5/1983 | Boogaart | 211/71 |

OTHER PUBLICATIONS 1 page TX RX Systems, Inc. sales literature entitled "Mechanical Configuration 800 Transmitter-Receiver Trunking System".

TX RX Systems, Inc. Installation Photograph No. 1.

TX RX Systems, Inc. Installation Photograph No. 2.

*Primary Examiner*—Ramon S. Britts

*Assistant Examiner*—Sarah A. Lechok

*Attorney, Agent, or Firm*—Bean, Kauffman & Bean

[57] ABSTRACT

A light weight mounting fixture is disclosed for use in supporting a plurality of articles, such as cylindrical cavity filters, of like length in a manner permitting rigidity of the articles to be employed to rigidify the fixture.

16 Claims, 5 Drawing Figures

FIXTURE FOR MOUNTING CYLINDRICAL CAVITY FILTERS

BACKGROUND OF THE INVENTION

Filter cavities of the type described for instance in my prior U.S. Pat. No. 4,249,147 and intended to be used in forming a multicoupler system have heretofore been mounted on commercially available steel relay racks comprising a pair of side panels arranged to upstand in a parallel relationship from a common base and a top panel for connecting the upper ends of the side panels, whereby to define a rigid open ended structure. Typically, in racks of this type, the side panels are fitted with flanges having apertures intended to receive threaded fasteners or bolts for use in mounting a plurality of shelves to extend horizontally between the side panels and in a vertically spaced relationship. To adapt these racks for use in supporting cylindrically shaped filter cavities, it was necessary to replace the shelves with pairs of aluminum cross bars, which had their opposite ends fixed to the side panel flanges and were in turn fitted with aligned pairs of upstanding mounting flanges spaced lengthwise of their associated cross bars to engage with circumferentially spaced portions of the cylindrical side surface of each filter cavity adjacent its opposite ends. The ends of the filter cavities were then clamped to each associated pair of mounting flanges by a pair of conventionally metal binder straps arranged to encircle such ends and pass through holes punched in the mounting flanges.

This prior arrangement suffered from the drawback that commercially available steel racks are expensive, quite heavy and require large fixed size installation spaces, which may result in substantial waste in such space when a particular installation does not require a sufficient number of cavity filters to fill a given conventionally sized rack to capacity.

SUMMARY OF THE INVENTION

The present invention is directed towards a fixture for use in mounting a plurality of articles, such as cylindrical cavity filters, wherein the rigidity of the articles is employed to rigidity the fixture, such as to allow the fixture to be of an extremely simple, light weight and inexpensive construction.

The present fixture comprises a frame defined by a pair of mounting members and means for positioning the mounting members in an essentially parallel relationship with their facing surfaces spaced apart through a distance slightly greater, but essentially corresponding to a common length of articles to be mounted; and attachment means including mounting member supported pins and conventional metal binder straps, for attaching opposite ends of the articles to the mounting members, such that the articles may be disposed in a closely spaced relationship to permit an assembly comprised of the fixture and articles to occupy a minimum volume. The frame may be hung from a ceiling or supported on a floor by removably fitting lower ends of the mounting members with a pair of support devices.

In that rigidity is imparted to the assembly by the articles and the mode of attaching same to the frame, the frame itself may be of a relatively flimsy, light weight structure, which may be shipped in a knocked down condition and readily assembled at a point of use.

DRAWINGS

The nature and mode of operation of the present invention will now be more fully described in the following detailed description taken with the accompanying drawings wherein.

DETAILED DESCRIPTION

Figure 1:
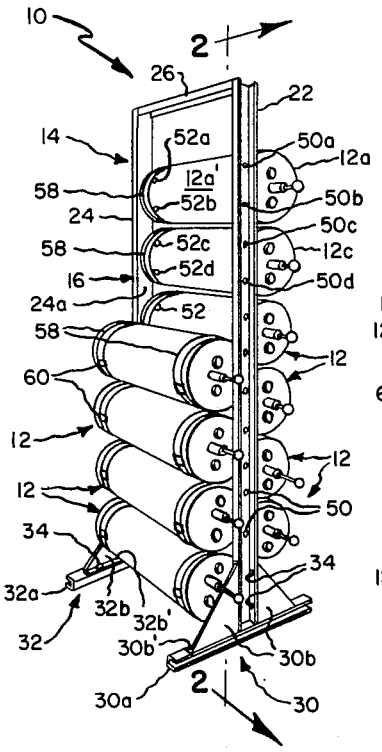
FIG. 1 is a perspective view of an assembly formed in accordance with a preferred form of the present invention with several filter cavities removed for purposes of clarity.

Reference is first made to FIG. 1, wherein 10 designates an assembly defined by mounting at least one end and preferably a plurality of rigid, cylindrical articles, such as cavity filter units 12 of the type described for instance in U.S. Pat. No. 4,249,147, on a mounting fixture 14 formed in accordance with the present invention. Commercially available units of this type are characterized as having their cylindrical side walls fabricated from lengths of relatively thick wall aluminum pipe and are presently available in several different sizes. When assembly 10 is intended to include more than one of units 12, all of such units would be of like length and of the same or different diameter, depending upon installation requirements.

Figure 2:
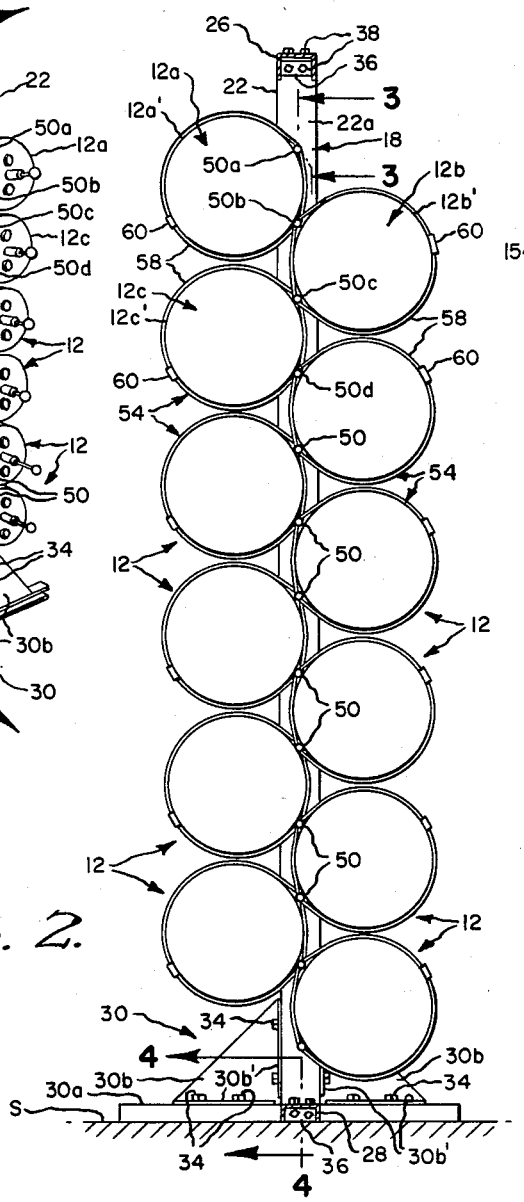
FIG. 2 is a sectional view taken generally along the line 2—2 in FIG. 1.
Figure 3:
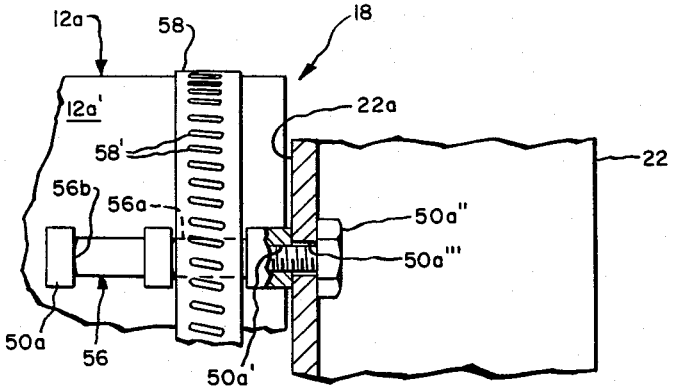
FIG. 3 is a sectional view taken generally along the line 3—3 in FIG. 2.

Fixture 14 is best shown in FIGS. 1, 2 and 3 as generally comprising a knock down frame 16, which is of a relatively light weight construction; and attachment means 18 for use in attaching units 12 to the frame in a manner permitting the rigidity of the units to be employed to rigidify the frame. Frame 16 includes a pair of like mounting members 22 and 24; and means such as a pair of like connecting or upper and lower members 26 and 28, which serve to position the mounting members in an essentially parallel relationship, wherein their facing or inner surfaces **22*a* and 24*a* are spaced apart through a distance essentially corresponding to the length of units 12, as indicated in FIG. 3. In a presently preferred construction, frame 16 additionally includes a pair of like support devices 30 and 32, which serve to support frame 16 to upstand from a horizontal surface "S". Support devices comprise channel shaped bases 30*a* and 32*a* and pairs of triangularly shaped bracing plates 30*b*, 30*b* and 32*b*, 32*b* having mounting flanges 30*b*', 30*b*' and 32*b*', 32*b*', respectively. Plates 30*b* and 32*b* may be suitably fixed to bases 30*a* and 30*b* by bolt devices 34, as indicated in FIGS. 1–4**.

In the construction illustrated in the drawings, L-shaped mounting brackets 36 and bolt devices 38 are employed to attach opposite ends of upper member 26 to the upper ends of mounting members 22 and 24 and the opposite ends of lower member 28 to the midpoint of bases **30*a* and 32*a*. It is anticipated that for certain installations, where it is desired to suspend frame 16 from a ceiling or overhead beam, as by passing wires or hooks through apertures, not shown, provided in upper member 26, support devices 30 and 32 may be dispensed with in which case lower member 28** could be bolt affixed directly to the lower ends of mounting members 22 and 24. Further, it will be understood that lower member 28 is employed in the preferred construction primarily for the purpose of providing temporary rigidity for frame 16 prior to installation of units 12 in the manner to be described in order to prevent converging-/diverging movements of the lower ends of mounting members 22 and 24, which might result in injury to the joined ends of members 22, 24 and 26 in the event the frame is subjected to rough handling conditions.

In a presently preferred construction, attaching means includes a pair of like groups of aligned pins 50 and 52 supported on mounting members 22 and 24 to extend or project from their facing surfaces 22*a* and 24*a* and lie within a common plane, which vertically bisects the mounting members; and strap means 54 arranged to encircle opposite ends of each of units 12 and associated pairs of pins for purposes of clamping the units to the pins and thus to frame 16. The spacing between adjacent pins of each group of pins is uniform for the preferred form of the invention and particularly for the case wherein assembly 10 is intended to only include units 12 of like diameter. Pins 50 and 52 may be fixed to mounting members 22 and 24 in any desired manner, such as is shown by way of example in FIG. 3 for the case of pin 50*a*, wherein the relatively outer end of such pin is provided with a bore opening 50*a*′ threaded to receive a bolt 50*a*″ extending through an aperture 50*a*‴ formed in mounting member 22. In the presently preferred construction pins 50 and 52 are provided with recess means 56 sized to freely receive a pair of strap means 54 when trained thereabout. While recess means 56 may be defined by a single annular recess having a width or axial dimension sufficient to receive a pair of adjacently disposed strap means 54, such means is preferably defined by a pair of axially spaced recesses 56*a* and 56*b*, which are individually sized to freely receive a single strap, as is also shown in FIG. 3. The depth or radial dimension of recesses 56*a* and 56*b* is made sufficient to exceed the thickness of the strap means intended to be employed in the mounting of units 12.

Strap means 54 may be of desired construction, but are preferably in the form of commercially available stainless steel binder straps or bands 58 having "thread" openings 58′ arranged adjacent one end thereof and screw type tightening devices 60 fixed to their opposite ends for engagement with openings 58′ when the strap ends are arranged in a lapped condition.

As regards any given one of units 12, such as the one designated for instance as 12*a* in FIGS. 1, 2 and 3, two pairs of aligned pins, such as those designated as 50*a*, 50*b* and 52*a*, 52*b* in FIGS. 1 and 2, are required to mount the unit on frame 16. If only unit 12*a* is required to be mounted in any given assembly, the spacing between adjacent pins 50*a*, 50*b* and 52*a*, 52*b* is not critical, so long as such spacing permits the pins to simultaneously engage with a side surface 12*a*′ of unit 12*a* adjacent its ends when placed thereagainst. The subsequent application of straps 58 to encircle the ends of unit 12*a* and their associate pairs of pins 50*a*, 50*b* and 52*a*, 52*b* creates an assembly in which frame 16 is rendered more rigid by the strength of the cylindrical side wall of the unit and its mode of connection to the frame.

By again viewing FIGS. 1 and 2, it will be understood that an additional unit 12*b*, whose diameter may be the same or differ from that of unit 12*a*, may be mounted on frame 16 by providing two additional pins 50*c* and 52*c*, which are disposed in alignment and spaced from given ones of the pins of the initial pairs of pins such as pins 50*b* and 52*b* through a distance permitting such pins to simultaneously engage with side surface 12*b*′ of the additional unit adjacent its opposite ends. Mounting of unit 12*b* is completed by the application of strap means 54 to encircle its ends and their associated pairs of pins 50*b*, 50*c* and 52*b*, 52*c*. It will be noted that the provision of recess means 56 in pins 50*b* and 52*b* permits threading of binder straps 58 between such pins and surface 12*a*′ of previously installed unit 12*a* and provides for a compact installation, wherein the spacing between side surfaces 12*a*′ and 12*b*′ is defined by the diameter of pins 50*b* and 52*b*. A further additional unit 12*c* may then be added by providing aligned pins 50*d* and 52*d* and applying strap means to encircle its ends and clamp its side surface 12*c*′ against associated pairs of pins 50*c*, 50*d* and 52*c*, 52*d*. In a like manner, more units may be mounted until there is created a typical assembly, such as that illustrated in FIGS. 1 and 2, wherein for instance, twelve 10 inch diameter units 12 of like length are arranged to form a pair of columns, wherein the units of one of the columns are arranged in a staggered relationship relative to the units of the other column with adjacent units of each column having their side surfaces arranged in relatively close proximity to each other, as well as the side surfaces of adjacent units of the other column. The close proximity of side surfaces of adjacent units of the same column, which need be sufficient only to permit threading of binder straps 58 therebetween, may be obtained by proper spacing of pins 50 and 52, which will vary depending on the diameter of the units to be installed, whereas the close spacing between adjacent units of the pair of columns results from the fact that such units engage with common mounting pins. The rigidity of assembly 10 increases with the number of units it incorporates.

It will be understood that for an assembly formed from units of like diameter, the spacing between pins 50 and 52 may be equal such that the axes of units 12 in each column of units lie within a common plane parallel to the plane bisecting pins 50 and 52, as best shown in FIG. 2. When one or more of the installed units differs in diameter, the axes of all units in each column no longer reside in a common plane, but by proper selection of the distance between the pins with which they engage, a relatively close spacing can still be maintained between adjacent units of different diameter in each column.

The above described construction of frame 16 admits to substantial use of relatively light weight aluminum extrusions and plates with the result that the overall weight of an average assembly, minus units 12, will vary between twenty and thirty pounds, depending upon the lengths of connecting members 26 and 28. By comparison, a commercially available steel relay rack sized to support a comparable number of units will likely exceed one hundred pounds and thus be more expensive to ship to a point of use.

Figure 5:
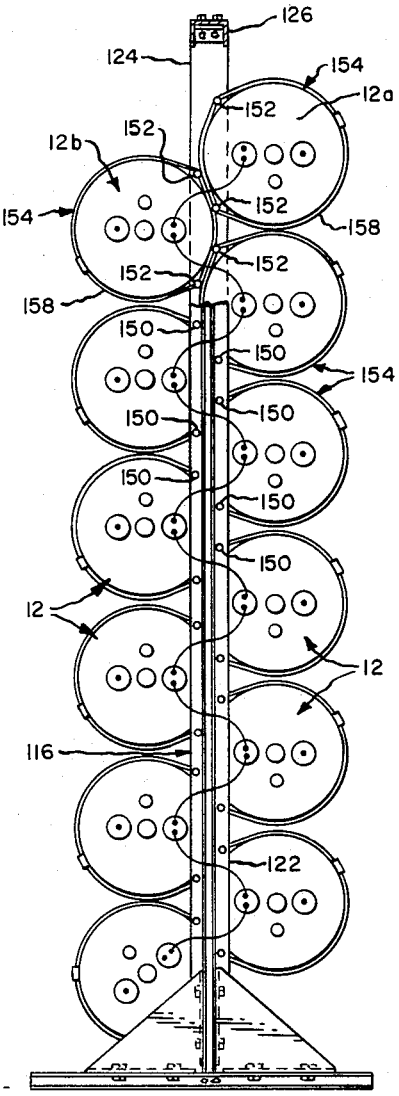
FIG. 5 is a side elevational view of an alternative form of the present invention.
Figure 4:
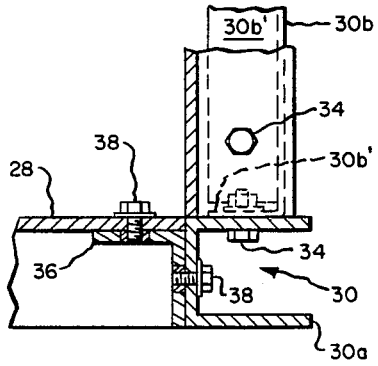
FIG. 4 is a sectional view taken generally along the line 4—4 in FIG. 2.

Reference is now made to FIG. 5, which illustrates an original form of the present invention, which has been superseded by the presently preferred form illustrated in FIGS. 1–4. This original construction is similar from the standpoint that it includes a frame 116 defined by a pair of mounting members 122 and 124, which are joined in an essentially parallel relationship by a pair of connecting members, only one of which is shown and designated as 126; and attaching means including a pair of like groups of aligned pins 150 and 152 supported by members 122 and 124 to extend from their facing surfaces and a plurality of pairs of strap means 154 arranged to encircle opposite ends of units 12 and the pairs of pins with which the units engage. This construction differs from that previously described in that the groups of pins 150 and 152 are each arranged in two columns of pins bisected by a pair of parallel planes extending lengthwise of mounting members 122 and 124, wherein pins in one column of pins are vertically staggered with respect to pins in the other column of pins and engage only with units 12 of one of the columns of units. Moreover, in this construction, pins 150 and 152 are not required to be provided with recess means for receiving strap means 154, although same may be provided, if desired, to more positively prevent displacements of such straps axially of their associated pins.

Thus, with reference to pins 152 in FIG. 5, it will be noted that the upper unit 12*a* of the right hand column of the units is arranged to engage with the two upper pins 152 of the right hand column of pins, which together with such unit is encircled by strap means 154, but would normally not engage with the uppermost pin 152 of the left hand column of pins, due to the necessity of passing binder strap 158 between this latter pin and the surface of unit 12*a*. Viewed alternatively, it will be noted that the upper unit 12*b* of the left hand column of the units is arranged to engage with the two upper pins 152 of the left hand column of pins, which together with such unit is encircled by its strap means 154, but would normally not engage with the second and third pins from the top of the right hand column of pins, due to the necessity of passing binder strap 158 between these latter pins and the surface of unit 12*b*. However, the resultant spacing between adjacent units of adjacent columns need only be slightly larger than that achieved in the preferred form of the invention, such that the construction of FIG. 5 also provides a compact assembly.

Although the assembly illustrated in FIG. 5 is not preferred in that it requires a larger number of pins to be employed, it still possesses the other advantages of the preferred form of the present assembly when compared to the prior accepted practice of mounting units on commercially available steel relay racks.

While the present invention is primarily intended for use in providing an improved means for mounting certain cavity filters, it is anticipated that the invention may be used to advantage in mounting any type of cylindrical article, so long as same includes a side wall having sufficient rigidity to withstand collapse under the clamping load imposed by its mounting straps, as well as other loadings required to maintain the mounting members in a properly spaced and aligned relationship.

What is claimed is:

1. An assembly comprising:

at least one rigid cylindrical article having a given length;

a frame including a pair of mounting members and means positioning same in an essentially parallel relationship with facing surfaces of said mounting members spaced apart through a distance essentially corresponding to said given length; and attachment means attaching opposite ends of said article one to each of said mounting members, said attachment means including at least two pairs of pins supported one pair on each of said mounting members projecting from said facing surfaces in an essentially aligned relationship with the pins of each pair spaced apart through a distance simultaneously engaging a cylindrical side surface of said article adjacent its ends, and strap means encircling said ends of said article and pairs of pins clamping said pairs of pins in engagement with said side surface.

2. An assembly according to claim 1, wherein said frame additionally includes a pair of support devices fixed one to each of said mounting members for supporting said frame to vertically upstand from a horizontal surface.

3. An assembly according to claim 1, wherein at least one of said pins of each pair of pins is provided with slot means and said strap means is received within said slot means, said slot means having a depth exceeding the thickness of said strap means.

4. An assembly according to claim 1, wherein said assembly is provided with an additional cylindrical article having said given length; and said attachment means includes two additional pins supported one on each of said mounting members to project from said facing surfaces in an essentially aligned relationship with said additional pins being parallel to and spaced apart from given ones of the pins of each of said pairs of pins through a distance permitting simultaneous engagement of said additional pins and given ones of said pins with a side surface of said additional article adjacent its ends when placed thereagainst, at least said given ones of said pins are provided with slot means, and additional strap means encircling said ends of said additional article, said additional pins and said given ones of said pins clamping said additional pins and said given ones of said pins in engagement with said side surface of said additional article, and said strap means and additional strap means are received within said slot means, said slot means having a depth exceeding the thickness of said strap means and said additional strap means.

5. An assembly according to claim 4, wherein the pins supported by each of said mounting members are lengthwise bisected by a plane extending lengthwise of said mounting members.

6. An assembly according to claim 5, wherein the spacing between adjacent ones of said pins supported by each of said mounting members is essentially equal.

7. An assembly according to claim 5 or 6, wherein said slot means includes a pair of slots spaced apart lengthwise of said given ones of said pins, said strap means is received within one of said slots and said additional strap means is received within the other of said slots.

8. An assembly according to claim 1, wherein said assembly is provided with an additional cylindrical article having said given length; and said attachment means includes at least two additional pairs of pins supported one pair on each of said mounting members to project from said facing surfaces in an essentially aligned relationship with the pins of each additional pair spaced apart through a distance permitting simultaneous engagement thereof with a side surface of said additional article adjacent its ends when placed thereagainst, and additional strap means encircling each of said ends of said additional article and additional pair of pins associated therewith for clamping said additional pairs of pins in engagement with said side surface of said additional article, said pairs of pins and said additional pairs of pins being lengthwise bisected by a pair of parallel planes.

9. An assembly according to claim 8, wherein the spacing between said pairs of pins and said additional pairs of pins is equal, said planes extend lengthwise of said mounting members, and said additional pairs of pins are arranged in a staggered relationship relative to said pair of pins.

10. An assembly comprising:

a plurality of rigid cylindrical articles having a given length;

a frame including a pair of mounting members and means positioning same in an essentially parallel relationship with facing surfaces of said mounting members spaced apart through a distance essentially corresponding to said given length; and attachment means attaching opposite ends of said articles one to each of said mounting members defining with said frame a rigid structure, wherein said articles are arranged in a pair of columns, and articles in one column of articles are staggered relative to articles of the other column of articles, said attaching means including two like groups of aligned pins carried one group on each of said mounting members and projecting from said facing surfaces thereof, each of said articles having opposite ends of its cylindrical side surface engaging a pair of adjacent pins of each said group, and a pair of straps for each of said articles and encircling said opposite ends and the pins engaged therewith.

11. An assembly according to claim 10, wherein each of said groups of pins are bisected by a common plane extending lengthwise of said mounting members, certain aligned ones of said pins engage with the side surface of one of said articles in each said column of articles and each of said certain aligned ones of said pins is formed with recess means to receive straps encircling said one of said articles of each column of articles with which it engages, said recess means having a depth exceeding the thickness of said straps.

12. An assembly according to claim 10, wherein the pins of each said group are arranged in a pair of columns of pins extending lengthwise of said mounting members with the pins of one column of pins staggered relative to the pins of the other column of pins, the pins of said one column of pins of each group engaging with the articles of said one column of articles and the pins of said other column of pins of each group engaging with the articles of said other column of articles.

13. An assembly comprising in combination:

a plurality of filter cavities having a given length and rigid cylindrical shaped side walls;

a frame including a pair of mounting members and means for positioning same in essentially parallel relationship with facing surfaces of said mounting members spaced apart through a distance essentially corresponding to said given length; and attachment means attaching opposite ends of said filter cavities to said mounting members to position said filter cavities in a pair of columns and to rigidify said frame, wherein filter cavities in one column are staggered relative to filter cavities in the other column and the outer surfaces of their side walls are positioned in proximity with the outer surfaces of the side walls of adjacent filter cavities of said one column and in proximity with the outer surfaces of the side walls of adjacent filter cavities of said other column, said attachment means including two like groups of pins carried one group on each of said mounting members and extending in an aligned relationship from said facing surfaces, said pins of each group having a spacing between adjacent pins in each group engaging an outer surface of the side wall of a filter cavity placed thereagainst, certain aligned ones of said pins engage with the outer surface of the side wall of one of said filter cavities in each column and are provided with slot means, said pins are lengthwise bisected by a common plane extending lengthwise of said mounting members, and a pair of straps for each filter cavity and encircling opposite ends thereof and said pairs of adjacent pins in engagement with the outer surface of its side wall, and said pairs of straps are received within said slot means of said pair of adjacent pins, said slot means having a depth exceeding the thickness of said straps.

14. An assembly according to claim 13, wherein said slot means includes a pair of slots spaced apart lengthwise of each pin, one of said slots receiving a strap for encircling an adjacent filter cavity in one of said columns and the other of said slots receiving a strap for encircling an adjacent filter cavity in the other of said columns.

15. An assembly according to claim 14, wherein said frame additionally includes a pair of support devices removably fixed one to each of said mounting members for supporting said frame to vertically upstand from a horizontal surface.

16. An assembly according to claim 13, 14 or 15, wherein the spacing between adjacent pins of each group is essentially equal.

* * * * *